US010458370B2

(12) United States Patent
Davison et al.

(10) Patent No.: US 10,458,370 B2
(45) Date of Patent: Oct. 29, 2019

(54) APPARATUS AND METHOD FOR EXHAUST GAS RECIRCULATION

(71) Applicant: Bayerische Motoren Werke Aktiengesellschaft, Munich (DE)

(72) Inventors: Peter Davison, Steyr (AT); Anton Rudelstorfer, Weistrach (AT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/978,393

(22) Filed: May 14, 2018

(65) Prior Publication Data

US 2018/0258887 A1 Sep. 13, 2018

Related U.S. Application Data

(63) Continuation of application No. PCT/EP2016/079990, filed on Dec. 7, 2016.

(30) Foreign Application Priority Data

Jan. 18, 2016 (DE) ..... 10 2016 200 510

(51) Int. Cl.
*F02M 26/24* (2016.01)
*F02M 26/33* (2016.01)
(Continued)

(52) U.S. Cl.
CPC ..... *F02M 26/24* (2016.02); *F02M 26/25* (2016.02); *F02M 26/26* (2016.02); *F02M 26/28* (2016.02);
(Continued)

(58) Field of Classification Search
CPC ..... F02M 26/24; F02M 26/25; F02M 26/26; F02M 26/28; F02M 26/30; F02M 26/33
(Continued)

(56) References Cited

U.S. PATENT DOCUMENTS 5,732,688 A 3/1998 Charlton et al.
2007/0125081 A1* 6/2007 Czarnowski ..... F01N 3/021 60/599
(Continued)

FOREIGN PATENT DOCUMENTS

CN 103649512 A 3/2014
DE 197 33 964 A1 2/1999
(Continued)

OTHER PUBLICATIONS

International Search Report (PCT/ISA/210) issued in PCT Application No. PCT/EP2016/079990 dated Feb. 13, 2017 with English translation (six (6) pages).
(Continued)

*Primary Examiner* — Erick R Solis
(74) *Attorney, Agent, or Firm* — Crowell & Moring LLP

(57) ABSTRACT

An internal combustion engine has an exhaust gas recirculation system for recirculating exhaust gases from the internal combustion engine into an intake region of the internal combustion engine. The exhaust gas recirculation system includes the following components: at least one exhaust gas cooler through which a first flow path for recirculating exhaust gas extends, having at least one first cooling stage and at least one additional cooling stage, at least one flap arrangement by which the at least one additional cooling stage can be connected, a bypass line through which a second flow path for recirculating exhaust gas extends and by which the exhaust gas cooler can be bypassed during the recirculation of exhaust gas, and an EGR valve having at least three possible positions.

9 Claims, 5 Drawing Sheets

(51) Int. Cl.

| | |
|---|---|
| ***F02M 26/28*** | (2016.01) |
| ***F02M 26/25*** | (2016.01) |
| ***F02M 26/26*** | (2016.01) |
| ***F02M 26/30*** | (2016.01) |
| ***F02M 26/69*** | (2016.01) |
| ***F02M 26/71*** | (2016.01) |

(52) U.S. Cl.
CPC ..... *F02M 26/30* (2016.02); *F02M 26/33* (2016.02); *F02M 26/69* (2016.02); *F02M 26/71* (2016.02)

(58) Field of Classification Search
USPC ..... 123/568.12
See application file for complete search history.

(56) References Cited

U.S. PATENT DOCUMENTS

| | | | | |
|---|---|---|---|---|
| 2008/0223024 | A1 | 9/2008 | Kammler et al. | |
| 2009/0013978 | A1* | 1/2009 | Joergl | F02B 29/0418 123/568.12 |
| 2011/0108013 | A1 | 5/2011 | Melhem et al. | |
| 2014/0124691 | A1 | 5/2014 | Vitt et al. | |
| 2015/0176445 | A1* | 6/2015 | Han | F01M 5/001 123/568.12 |

FOREIGN PATENT DOCUMENTS

| | | | |
|---|---|---|---|
| DE | 198 12 702 | A1 | 9/1999 |
| DE | 697 20 661 | T2 | 10/2003 |
| DE | 10 2005 040 612 | A1 | 3/2007 |
| DE | 10 2006 052 972 | A1 | 5/2008 |
| DE | 10 2008 033 823 | A1 | 1/2010 |
| EP | 1 275 838 | A1 | 1/2003 |
| FR | 2879669 | A1 | 6/2006 |
| GB | 2473821 | A | 3/2011 |
| WO | WO 2012/152601 | A1 | 11/2012 |

OTHER PUBLICATIONS

German-language Written Opinion (PCT/ISA/237) issued in PCT Application No. PCT/EP2016/079990 dated Feb. 13, 2017 (seven (7) pages).

German-language Search Report issued in counterpart German Application No. 102016200510.3 dated Oct. 21, 2016 with English translation (twelve (12) pages).

* cited by examiner

APPARATUS AND METHOD FOR EXHAUST GAS RECIRCULATION

CROSS REFERENCE TO RELATED APPLICATIONS

This application is a continuation of PCT International Application No. PCT/EP2016/079990, filed Dec. 7, 2016, which claims priority under 35 U.S.C. § 119 from German Patent Application No. 10 2016 200 510.3, filed Jan. 18, 2016, the entire disclosures of which are herein expressly incorporated by reference.

BACKGROUND AND SUMMARY OF THE INVENTION

The invention relates to the recirculation of exhaust gas from a combustion chamber of an internal combustion engine, preferably of a motor vehicle, back into the combustion chamber.

Exhaust-gas recirculation systems serve in particular for reducing the emissions of nitrogen oxides. Environmentally harmful nitrogen oxides, inter alia, are formed during a combustion of fuel in a combustion chamber of an internal combustion engine, in particular if there is a high oxygen content in the combustion chamber. To reduce the emissions of nitrogen oxides, exhaust gas from a combustion chamber of an internal combustion engine can be diverted through pipelines and admixed to clean air that is supplied to the combustion chamber. Passing through the combustion chamber again results in the nitrogen oxide content in the exhaust gas being reduced. At the same time, the formation of nitrogen oxide itself is minimized.

Also known are apparatuses for cooling clean air and recirculated exhaust gas that are supplied to the combustion chamber. By cooling the clean air and the recirculated exhaust gas that are supplied to the combustion chamber, the combustion chamber can accommodate more clean air. The power and efficiency of the internal combustion engine are thus increased, because more oxygen is available for the combustion of fuel.

The known systems commonly have the disadvantage that the cooling power with which the recirculated exhaust gas is cooled in the cooling device is not adequately adjustable. This is a disadvantage in particular in low-load phases. Low load is to be understood to mean that the internal combustion engine is outputting only a part of its maximum power. In such low-load phases of the internal combustion engine, an excessively high level of cooling power may prevail. Too low a temperature of recirculated exhaust gas can lead to sooting of components. Here, sooting means that, in exhaust gas that is too cold, constituents of the exhaust gas condense out. Such constituents may be in particular water vapor, unburned hydrocarbons or acids.

Taking this as a starting point, it is an object of the present invention to solve or at least alleviate the technical problems discussed in conjunction with the prior art. It is sought in particular to propose an internal combustion engine having an exhaust-gas recirculation device which permits good adjustability of the cooling power with which the recirculated exhaust gas is cooled.

These and other objects are achieved by an internal combustion engine and a method of operating same in accordance with embodiments of the invention. Further advantageous refinements of the internal combustion engine are specified and claimed herein. The features specified individually may be combined with one another in any desired technologically meaningful manner, and may be supplemented by explanatory facts from the description, with further design variants of the invention being specified.

The apparatus according to the invention is an internal combustion engine having an exhaust-gas recirculation device for the recirculation of exhaust gases of the internal combustion engine into an intake region of the internal combustion engine. The exhaust-gas recirculation device has the following components:

- at least one exhaust-gas cooler through which a first flow path for the recirculation of exhaust gas runs and which has at least one first cooling stage and at least one additional cooling stage,
- at least one flap arrangement by which the at least one additional cooling stage is activatable,
- a bypass line through which a second flow path for the recirculation of exhaust gas runs and by which the exhaust-gas cooler can be bypassed during the recirculation of exhaust gas,
- an EGR valve having at least three possible positions:
  - a rest position, in which the exhaust-gas recirculation device is closed,
  - a first position, in which the first flow path through the exhaust-gas cooler is open, and
  - a second position, in which the second flow path through the bypass line is open.

In a preferred design variant, the internal combustion engine is an internal combustion engine with an exhaust-gas turbocharger. In the case of such internal combustion engines, a distinction can be made between high-pressure exhaust-gas recirculation and low-pressure exhaust-gas recirculation. In the case of high-pressure exhaust-gas recirculation, the exhaust gas is normally branched off upstream of an exhaust-gas side of the turbocharger and supplied to the compressed clean air downstream of a clean-air side of the turbocharger. "Upstream" means before the compressor in the flow direction of the clean air. "Downstream" means after the compressor in the flow direction of the clean air. In the case of low-pressure exhaust-gas recirculation, exhaust gas is branched off downstream of the exhaust-gas side of the turbocharger and is supplied to the clean air, which has not yet been compressed, upstream of the clean-air side of the turbocharger. Mixed forms and combinations of high-pressure exhaust-gas recirculation and low-pressure exhaust-gas recirculation are also known and technically possible.

The internal combustion engine may be envisaged in particular for a motor vehicle, a working machine, an aircraft or similar machines. The internal combustion engine normally has combustion chambers which are designed in the manner of cylinders. Clean air can be supplied to said combustion chambers via a clean-air conduit. After the combustion of fuel in the combustion chambers, exhaust gas can be discharged via an exhaust-gas system. The exhaust-gas system normally has an exhaust-gas aftertreatment device, for example having a catalytic converter and/or a particle filter for exhaust-gas purification. An exhaust-gas recirculation device is connected to the exhaust-gas system. Said exhaust-gas recirculation device comprises an exhaust-gas recirculation line between exhaust-gas conducting lines and the clean-air conduit. The exhaust-gas recirculation line may be formed at least partially by a hose or a pipe composed of rubber or plastic. Exhaust gas can be supplied to the clean-air conduit via the exhaust-gas recirculation device. As described above, this recirculation of exhaust gas is advantageous with regard to the minimization of nitrogen oxide emissions of an internal combustion engine. The exhaust gases may be recirculated into an intake region of the internal combustion engine.

In the embodiment described here, the exhaust-gas recirculation device has at least one exhaust-gas cooler, through which a first flow path runs, and a bypass line, through which a second flow path runs.

The exhaust-gas cooler is constructed such that exhaust gas that flows along the first flow path is cooled. This cooling may take place by virtue of exhaust gas on the first flow path passing through the at least one first cooling stage.

In addition to the first cooling stage, the exhaust-gas cooler has an additional cooling stage. Passage through multiple cooling stages signifies increased cooling power. A flow path for exhaust gas through the additional cooling stage is in this case also referred to as first flow path or as part of the first flow path.

The bypass line is constructed such that exhaust gas that flows along the second flow path is not cooled. This means that exhaust gas is conducted past the exhaust-gas cooler, that is to say the exhaust-gas cooler is bypassed.

In the exhaust-gas cooler, increased cooling power can be activated by way of the at least one flap arrangement. Multiple additional cooling stages may also exist. It is then preferably the case that one flap arrangement is provided per additional cooling stage. The flap arrangement may for example be a single flap which, in a first position, closes off an opening to the additional cooling stage in gas-type fashion, and which, in a second position, opens up the opening for the passage of exhaust gas to the additional cooling stage. The flap arrangement is integrated into the exhaust-gas cooler such that, when the flap is positioned in the first position, only the at least one first cooling stage is accessible to exhaust gas, and such that, in the second position of the flap, the at least one additional cooling stage is also additionally accessible.

Furthermore, an EGR valve is provided which serves for selectively opening the first cooling stage or the bypass line or completely closing the exhaust-gas recirculation device. Here, the abbreviation "EGR" stands for exhaust-gas recirculation. The EGR valve is a valve having at least three possible positions discussed further above: a rest position, a first position and a second position. The EGR valve may be a multi-way valve. The EGR valve makes it possible to set which of the described flow paths the exhaust gas follows. The EGR valve is normally situated in the rest position. This applies in particular when no forces act on the EGR valve. The EGR valve is for example pushed into the rest position by a spring. When the EGR valve is in the rest position, the exhaust-gas recirculation device is closed. This means that exhaust gas cannot flow either via the first flow path or via the second flow path. Thus, no exhaust gas passes out of the exhaust-gas-conducting lines into the clean-air conduit of the internal combustion engine. If the EGR valve is moved into the first position, then exhaust gas can flow via the first flow path. Here, the exhaust gas passes through the exhaust-gas cooler. Depending on the position of the flap arrangement, said exhaust gas passes through the at least one first cooling stage and possibly also an additional cooling stage (of the at least one additional cooling stage). If the EGR valve is moved into the second position, the second flow path is opened up. This means that exhaust gas flows past the cooling stages through the bypass line. Here, the exhaust gas is not actively cooled.

The described arrangement makes it possible to set the cooling power of the exhaust-gas cooler in at least three stages. The second flow path permits exhaust-gas recirculation without any active cooling, and the first flow path permits exhaust gas recirculation with cooling, wherein a different level of cooling power prevails depending on the number of accessible cooling stages.

According to a further embodiment of the described internal combustion engine, the at least one first cooling stage, the at least one additional cooling stage, the bypass line, the EGR valve and the flap arrangement are integrated in a housing of the exhaust-gas recirculation device.

Integrating the stated elements into a housing means that a compact design is possible.

It is particularly advantageous if, according to a further embodiment of the described internal combustion engine, the EGR valve and the flap arrangement are arranged such that an anchoring of the flap is provided on an outer wall of the EGR valve, wherein the outer wall of the EGR valve simultaneously constitutes an inner wall of the at least one first cooling stage and of the at least one second cooling stage.

The outer wall refers here in particular to a section of a housing of the EGR valve and of the cooling stages. The EGR valve may for example be of cylindrical design. In this case, the outer wall of the EGR valve is a shell surface or a shell-like section of a housing. The EGR valve may be integrated into the exhaust-gas cooler such that the shell surface is suitable for the fastening of the flap arrangement to said exhaust-gas cooler. This configuration permits a particularly compact design of the exhaust-gas recirculation device.

In a further embodiment of the described internal combustion engine, the bypass line is thermally insulated.

In particular, thermal insulation exists with respect to the at least one first cooling stage and the at least one additional cooling stage. For the thermal insulation, use may for example be made of a thermally insulating foamed material or a similar material that is normally used for thermal insulation in an internal combustion engine. Said material is in particular fitted between the at least one additional cooling stage and the bypass line such that thermal contact between the cooling stages and the bypass line is at least minimized. The at least one additional cooling stage is preferably arranged between the first cooling stage and the bypass line. The additional cooling stage is often not flowed through by exhaust gas. The additional cooling stage therefore possibly contributes to an improvement in the insulation of the bypass line with respect to the surroundings.

Thermal insulation of the bypass line makes it possible to maintain a temperature of exhaust gas that is recirculated through the bypass line. Such temperature maintenance may be expedient in low-load phases in order that the temperature of the recirculated exhaust gas is not reduced to too great an extent, and in particular also that condensation of the exhaust gas and the formation of deposits in the bypass line is (thermally) prevented. Thermal insulation is however preferably provided not only with respect to the exhaust-gas cooler and the cooling stages but also with respect to the surroundings.

In a further embodiment of the described internal combustion engine, the EGR valve is a disk valve which has an inlet, a first outlet and a second outlet. Here, the two outlets are arranged opposite one another. A first closure element is provided at the first outlet and a second closure element is provided at the second outlet. The two closure elements are braced relative to one another by means of a spring in order to close the outlets in a rest position. Furthermore, a slide is provided which can be actuated by an actuator in order to selectively open the closure element at the first outlet or the closure element at the second outlet.

This design variant defines a particularly advantageous construction of an EGR valve which makes it possible to realize the stated three possible positions (rest position, first position, second position). The disk valve is a valve in which the closure elements are of disk-shaped form. The disk valve described here is a three-way valve with one inlet and two outlets. A medium, such as for example a gas, can pass into the valve through the inlet and can possibly pass out of the valve through one of the two outlets. In the rest position, the closure elements are pressed against openings of the outlets by the spring. One spring is preferably used jointly for both closure elements. Therefore, the two outlets are arranged opposite one another. The use of one (common) spring for both outlets is thus possible. In the rest position, the valve is fully closed, that is to say both outlets are closed and the medium cannot pass through the valve. The fact that one of the outlets of the valve is open means that the closure element of the corresponding outlet is moved away from the opening such that a ring-shaped gap between the closure element and the opening permits a passage of the medium. In this design variant, it is normally possible for only one outlet alone to be open, and not for both outlets to be open at the same time. The slide reduces a connection between the valve and the actuator. By means of the slide, the position of both closure elements can be adjusted by means of the actuator. This may for example be performed in electronically controlled fashion. For this purpose, the actuator may for example be designed as an electric motor. The slide and the actuator likewise have a rest position and a deflected position. In the rest position, the slide does not displace either of the two closure elements. A movement out of the rest position of actuator and slide in a first direction displaces the first closure element at the first outlet. A movement out of the rest position of actuator and slide in a second direction displaces the second closure element at the second outlet.

It is furthermore advantageous if the actuator is designed such that the opening widths of the first outlet and of the second outlet can be adjusted in continuously variable fashion by means of the slide.

This means in particular that the opening width of the first outlet and the opening width of the second outlet are each adjustable in continuously variable fashion. This normally does not mean that the first outlet and the second outlet are actuable separately from one another such that both outlets (first outlet and second outlet) can be open simultaneously. It is preferably always the case that only either the first outlet or the second outlet can be open.

In a further embodiment of the described internal combustion engine, the at least one first cooling stage and the at least one additional cooling stage are arranged in parallel with respect to one another.

If the two cooling stages are designed for example in the form of pipes, a parallel profile permits a compact arrangement. Furthermore, the flow density of the exhaust gas through the cooling stages remains approximately constant regardless of how many cooling stages have been opened up. This is advantageous because energy-efficient cooling is thus possible, without cooling power being lost and boundary surfaces between the cooling stages.

Also proposed is a method for operating an internal combustion engine according to one of the described embodiments, having the following method acts:

a) deactivating the exhaust-gas recirculation by shutting off the exhaust-gas recirculation device, with the EGR valve set in the rest position, b) exhaust-gas recirculation during a low-load phase, wherein the exhaust-gas recirculation takes place through the bypass line, with the EGR valve set in the second position, wherein no cooling of the recirculated exhaust gas takes place, c) exhaust-gas recirculation during load operation, wherein the exhaust-gas recirculation takes place through the exhaust-gas cooler, with the EGR valve set in the second position, and d) enabling at least one additional cooling stage by the at least one flap arrangement if high-load operation is present.

The method steps a) to d) do not need to be performed in succession, but rather may be performed in any desired technologically meaningful sequence during the operation of an internal combustion engine.

Method step a) makes it possible to operate the internal combustion engine without exhaust-gas recirculation. Here, the EGR valve closes both the first outlet and the second outlet. This corresponds to the rest position of the EGR valve as already described above.

Method step b) can be utilized to permit exhaust-gas recirculation without cooling in a low-load phase. As described above, setting of the EGR valve into the second position makes the second flow path through the bypass line accessible to exhaust gas.

Method step c) is suitable for operation of the internal combustion engine with a load higher than the low load described under method step b). Here, the EGR valve is situated in the second position, such that the first flow path is opened up. Here, the at least one first cooling stage of the exhaust-gas cooler is accessible. Cooling of the recirculated exhaust gas takes place through said first cooling stage.

If, according to method step d), the at least one additional cooling stage is additionally activated, the cooling power can be increased. For this purpose, the flap arrangement is moved into the second position.

The particular advantages and configuration features presented for the described internal combustion engine may be applied and transferred in any desired technologically meaningful manner to the described method. The same applies to the particular advantages and configuration features presented for the described method, which may be applied and transferred to the described apparatus.

The invention is preferably used in a motor vehicle having an internal combustion engine with an exhaust-gas recirculation device which is designed according to one of the above-described embodiments and which is operated using the described method.

Other objects, advantages and novel features of the present invention will become apparent from the following detailed description of one or more preferred embodiments when considered in conjunction with the accompanying drawings.

The invention and the technical field will be discussed in more detail below on the basis of the figures. The figures show particularly preferred exemplary embodiments, to which the invention is however not restricted. In particular, it is pointed out that the figures and in particular the illustrated proportions are merely schematic.

DETAILED DESCRIPTION OF THE DRAWINGS

Figure 1:
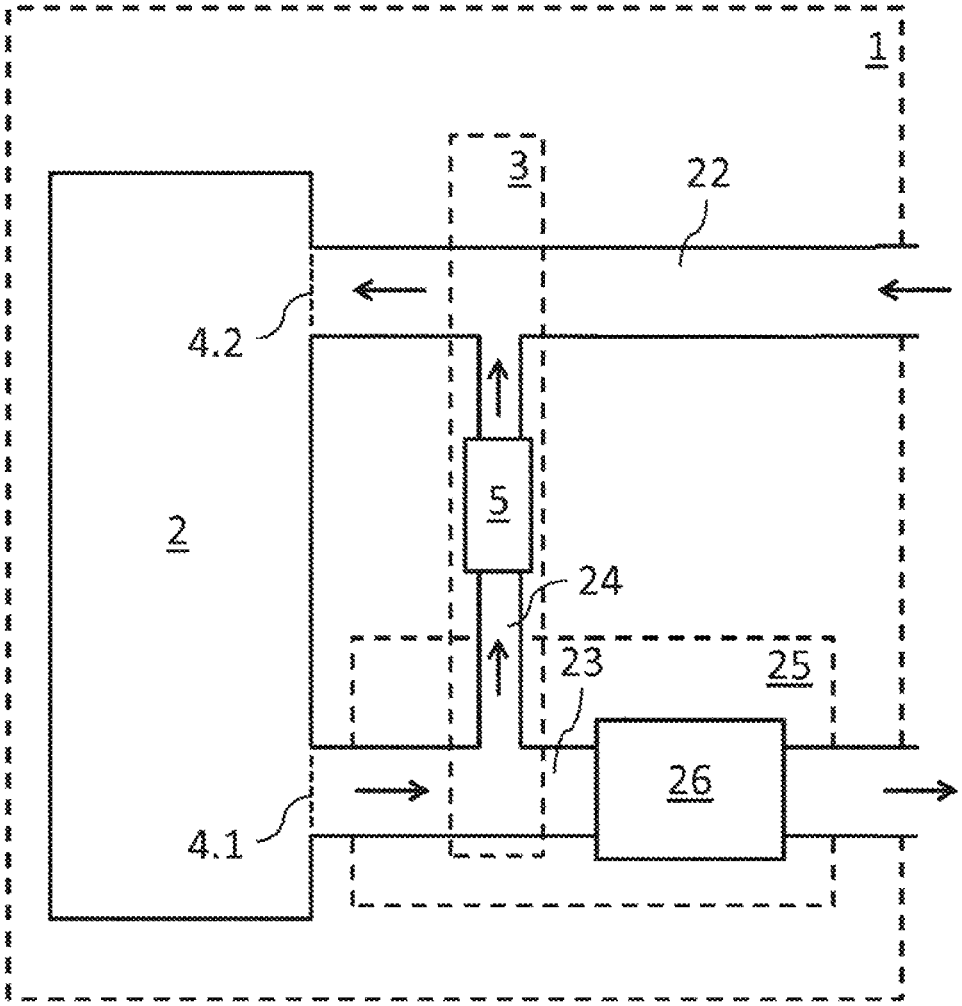
FIG. 1 is a schematic illustration of a motor vehicle having an internal combustion engine with exhaust-gas recirculation device according to an embodiment of the invention.

FIG. 1 shows a motor vehicle 1 in which an internal combustion engine 2 is integrated. Clean air from the surroundings can be drawn into an intake region 4.2 of the internal combustion engine 2 through a clean-air conduit 22. Fuel can be burned with the clean air in one or more combustion chambers of the internal combustion engine, whereby the motor vehicle 1 can be driven. Exhaust gas that is formed in the process can be discharged from the internal combustion engine 2 through an exhaust-gas outlet 4.1 and through an exhaust-gas line 23. Here, the exhaust gas passes through an exhaust-gas aftertreatment apparatus 25, which includes a catalytic converter 26. Exhaust gas from the exhaust-gas line 23 can be recirculated into the clean-air conduit 22 through an exhaust-gas recirculation line 24. Here, said exhaust gas can be cooled in an exhaust-gas cooler 5. The flow direction of the clean air and of the exhaust gas is indicated in each case by arrows.

Figure 2:
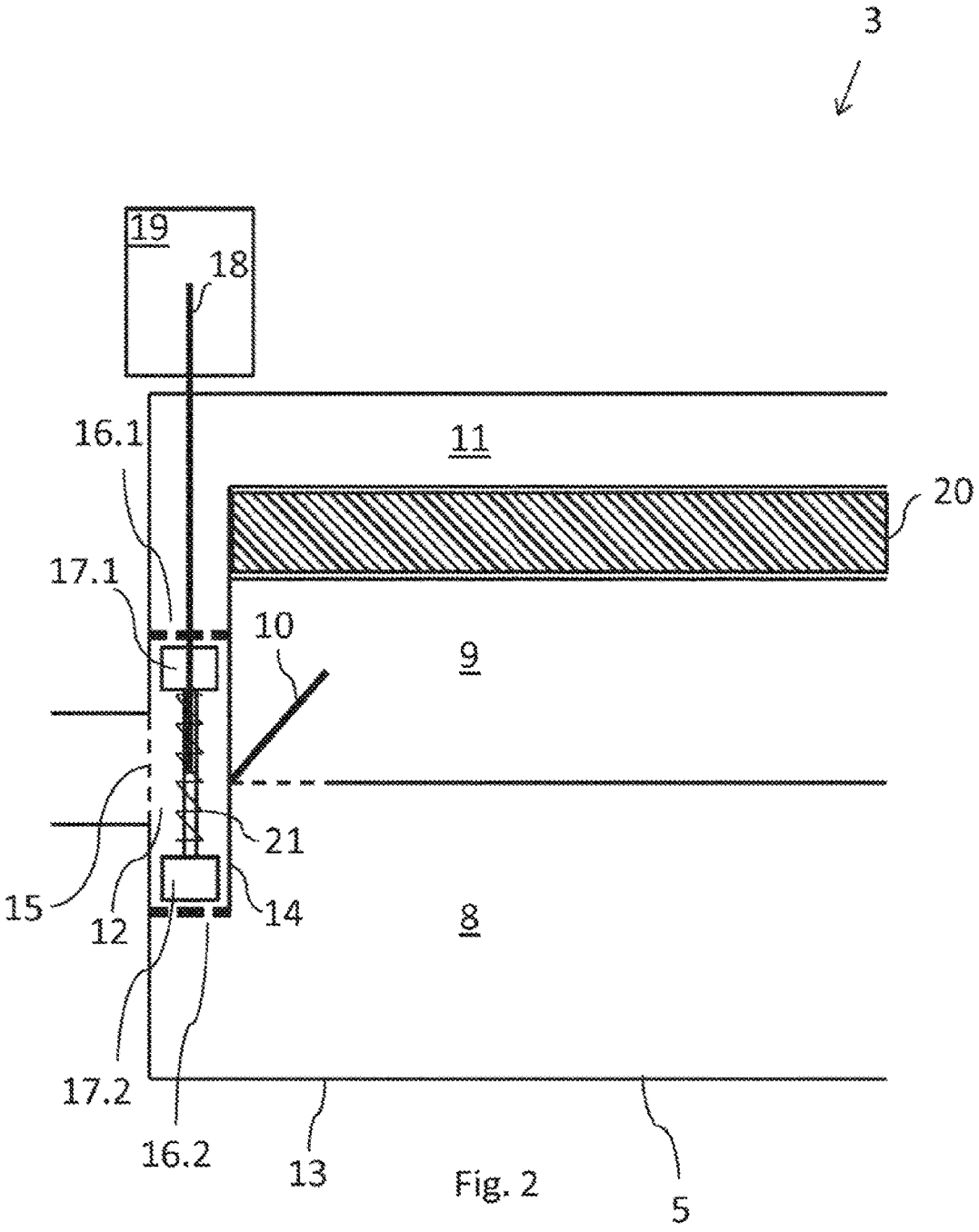
FIG. 2 is a schematic illustration of an exhaust-gas recirculation device for an internal combustion engine.

FIG. 2 is a schematic illustration of an exhaust-gas recirculation device 3 with an exhaust-gas cooler 5. In the illustration shown, a first cooling stage 8 is arranged in parallel with respect to an additional cooling stage 9. A bypass line 11 is arranged so as to be separated from the cooling stages 8 and 9 by way of thermal insulation 20. The bypass line 11 is preferably also insulated with respect to the surroundings. Furthermore, an EGR valve 12 is shown. The EGR valve 12 has an inlet 15, through which exhaust gas can enter the exhaust-gas cooler 5, a first outlet 16.1 at the bypass line 11 and a second outlet 16.2 at the first cooling stage 8. The EGR valve 12 is of cylindrical design. It has an outer wall 14. A first closure element 17.1 and a second closure element 17.2 are arranged in the interior of the EGR valve 12 such that the first outlet 16.1 and the second outlet 16.2 can be respectively closed by way of these closure elements. Owing to the oppositely situated arrangement of the first outlet 16.1 and of the second outlet 16.2, both the first outlet 16.1 and the second outlet 16.2 can be closed by the closure elements 17.1 and 17.2 by way of a spring 21. A slide 18 permits a continuously variable adjustment of the two closure elements 17.1 and 17.2. The slide 18 is operated via an actuator 19. The actuator 19 is preferably electronically controllable. The first cooling stage 8 and the additional cooling stage 9 are connectable by a flap arrangement 10. Here, the flap arrangement 10 is arranged on the outer wall 14 of the EGR valve 12, whereby exhaust gas that passes via the second outlet 16.2 of the EGR valve 12 into the first cooling stage 8 can pass via the flap arrangement 10 into the second cooling stage 9, such that the additional cooling stage 9 can be passed through over its full length. A first flow path runs through the second outlet 16.2 and the exhaust-gas cooler 5. A second flow path runs through the first outlet 16.1 and the bypass line 11.

Figure 3:
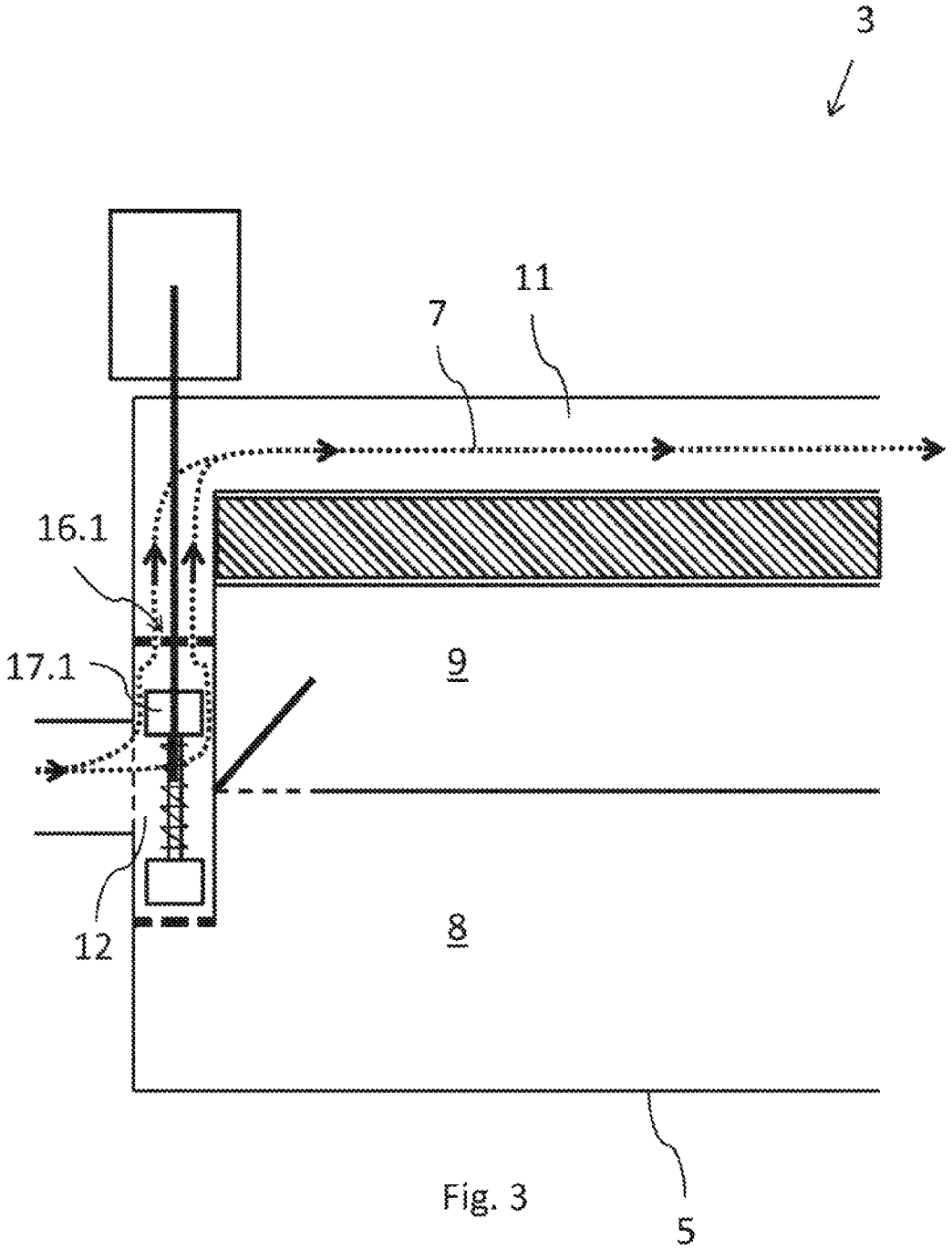
FIG. 3 is a schematic illustration of the exhaust-gas recirculation device in FIG. 2, in which the second flow path has been opened up.

FIG. 3 shows all of the elements and the same detail of the exhaust-gas cooler 5 from FIG. 2. For the sake of clarity, not all of the reference designations have been repeated in FIG. 3 (reference should be made to FIG. 2). The illustration shows that the second flow path 7 through the bypass line 11 has been opened up. For this purpose, the first closure element 17.1 of the EGR valve 12 is in a position which opens up the first outlet 16.1 of the EGR valve 12. Thus, exhaust gas can flow through the bypass line 11, as indicated by the arrows. The first cooling stage 8 and the additional cooling stage 9 are not accessible to exhaust gas.

Figure 4:
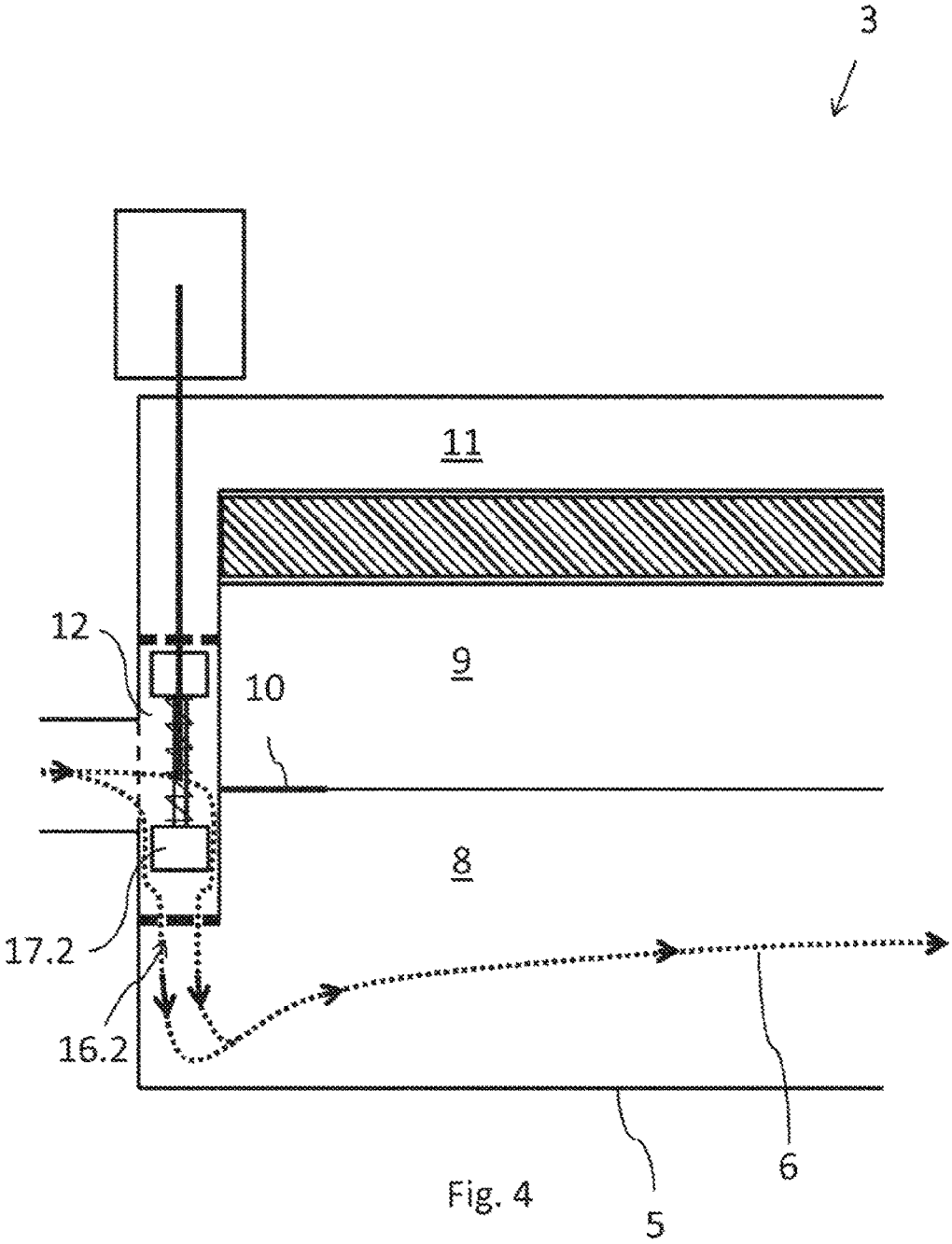
FIG. 4 is a schematic illustration of the exhaust-gas recirculation device in FIG. 2, in which the first flow path has been opened up.

FIG. 4 likewise shows the same detail of the exhaust-gas cooler 5 from FIG. 2. Therefore, in this case too, reference is made to FIG. 2. A situation is illustrated in which the first flow path 6 has been opened up. Exhaust gas can flow through the EGR valve 12 and through the first cooling stage 8, as indicated by arrows. Here, said exhaust gas is cooled in the first cooling stage 8. The second closure element 17.2 is in a position which opens up the second outlet 16.2 of the EGR valve. The flap arrangement 10 is closed, as a result of which the additional cooling stage 9 is not accessible to exhaust gas. The bypass line 11 is also not accessible.

Figure 5:
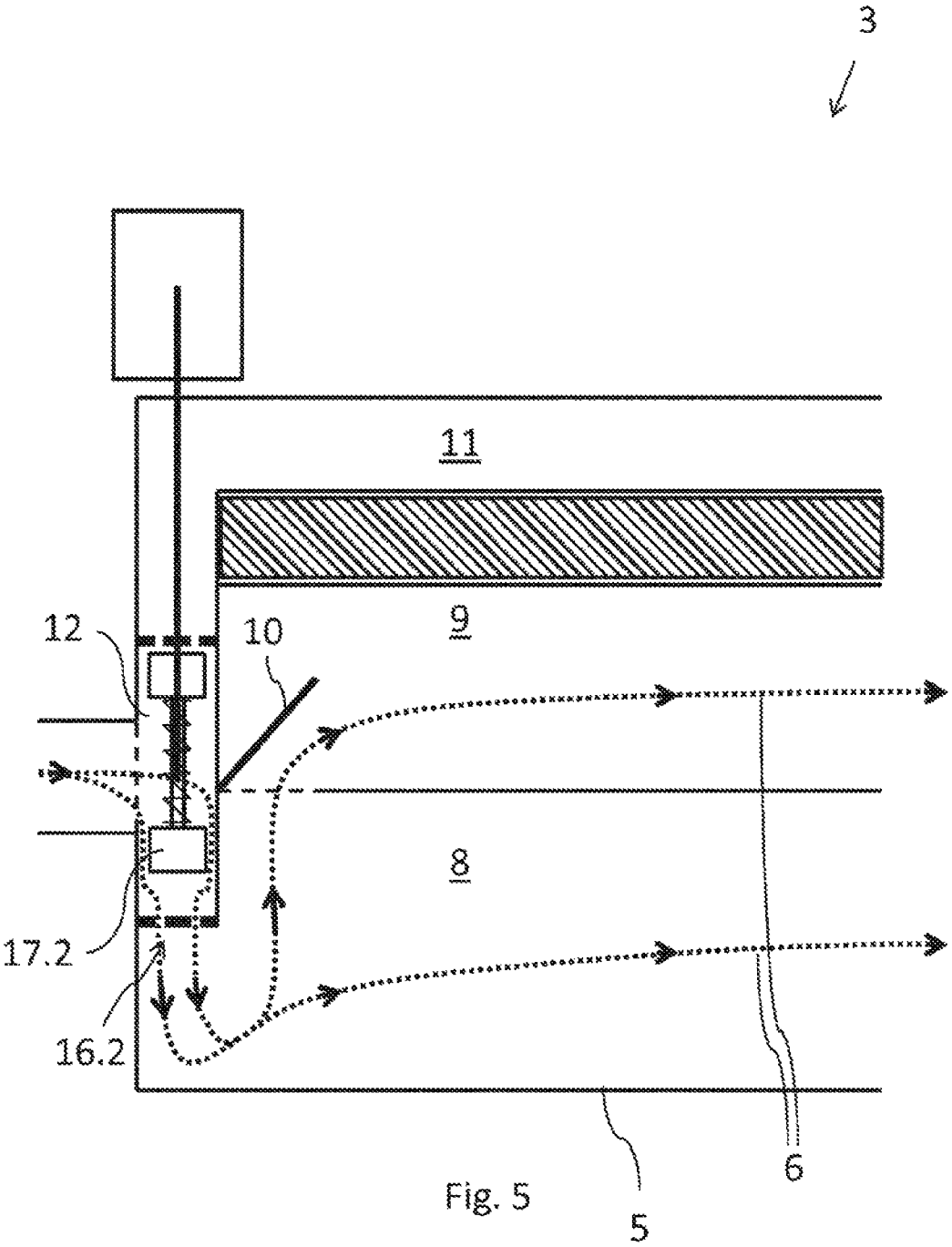
FIG. 5 is a schematic illustration of the exhaust-gas recirculation device from FIG. 2, in which the first flow path has been opened up, and in which an additional cooling stage has been activated.

FIG. 5 differs from FIG. 4 merely in that the flap arrangement 10 is open in this case. Thus, the additional cooling stage 9 has been activated. As illustrated by arrows, exhaust gas can flow not only through the first cooling stage 8 but also through the additional cooling stage 9. Here, the exhaust gas is also cooled in the additional cooling stage 9, and for this purpose, the first flow path 6 has been expanded such that it also runs through the additional cooling stage 9. Altogether, therefore, the cooling power of the situation illustrated in FIG. 5 is greater than the cooling power of the situation illustrated in FIG. 4.

LIST OF REFERENCE DESIGNATIONS

1 Motor vehicle
2 Internal combustion engine
3 Exhaust-gas recirculation device
4 Exhaust-gas outlet
4.2 Intake region
5 Exhaust-gas cooler
6 First flow path
7 Second flow path
8 First cooling stage
9 Additional cooling stage
10 Flap arrangement
11 Bypass line
12 EGR valve
13 Housing
14 Outer wall
15 Inlet
16.1 First outlet
16.2 Second outlet
17.1 First closure element
17.2 Second closure element
18 Slide
19 Actuator
20 Thermal insulation
21 Spring
22 Clean-air conduit
23 Exhaust-gas line
24 Exhaust-gas recirculation line
25 Exhaust-gas aftertreatment apparatus
26 Catalytic converter The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. An internal combustion engine, comprising:

an exhaust-gas recirculation device that recirculates exhaust gases of the internal combustion engine into an intake region of the internal combustion engine, wherein the exhaust-gas recirculation device comprises:

(a) at least one exhaust-gas cooler through which a first flow path for recirculation of exhaust gas runs and which has at least one first cooling stage and at least one additional cooling stage;

(b) at least one flap arrangement by which the at least one additional cooling stage is activatable;

(c) a bypass line through which a second flow path for the recirculation of exhaust gas runs and by which the exhaust-gas cooler can be bypassed during the recirculation of exhaust gas; and (d) an EGR valve having at least three possible positions:

(1) a rest position, in which the exhaust-gas recirculation device is closed, (2) a first position, in which the first flow path through the exhaust-gas cooler is open, and (3) a second position, in which the second flow path through the bypass line is open.

2. The internal combustion engine as claimed in claim 1, wherein the at least one first cooling stage, the at least one additional cooling stage, the bypass line, the EGR valve and the flap arrangement are integrated in a housing of the exhaust-gas recirculation device.

3. The internal combustion engine as claimed in claim 2, wherein the EGR valve and the flap arrangement are arranged such that an anchoring of the flap is provided on an outer wall of the EGR valve, and the outer wall of the EGR valve simultaneously constitutes an inner wall of the at least one first cooling stage and of the at least one second cooling stage.

4. The internal combustion engine as claimed in claim 1, wherein the bypass line is thermally insulated.

5. The internal combustion engine as claimed in claim 1, wherein the EGR valve is a disk valve which has an inlet, a first outlet and a second outlet, the first and second outlets are arranged opposite one another, a first closure element is provided at the first outlet and a second closure element is provided at the second outlet, the first and second closure elements are braced relative to one another by a spring in order to close the first and second outlets in a rest position, and a slide is provided which is actuatable by an actuator in order to selectively open the first closure element at the first outlet or the second closure element at the second outlet.

6. The internal combustion engine as claimed in claim 5, wherein the actuator is configured such that opening widths of the first outlet and of the second outlet are adjustable in a continuously variable manner by the slide.

7. The internal combustion engine as claimed in claim 1, wherein the at least one first cooling stage and the at least one additional cooling stage are arranged in parallel with respect to one another.

8. A method of operating an internal combustion engine, equipped with an exhaust-gas recirculation device that recirculates exhaust gases of the internal combustion engine into an intake region of the internal combustion engine, wherein the exhaust-gas recirculation device comprises:

(a) at least one exhaust-gas cooler through which a first flow path for recirculation of exhaust gas runs and which has at least one first cooling stage and at least one additional cooling stage;

(b) at least one flap arrangement by which the at least one additional cooling stage is activatable;

(c) a bypass line through which a second flow path for the recirculation of exhaust gas runs and by which the exhaust-gas cooler can be bypassed during the recirculation of exhaust gas; and (d) an EGR valve having at least three possible positions:

(1) a rest position, in which the exhaust-gas recirculation device is closed, (2) a first position, in which the first flow path through the exhaust-gas cooler is open, and (3) a second position, in which the second flow path through the bypass line is open, the method comprising the acts of:

a) operating the internal combustion engine without exhaust-gas recirculation by shutting off the exhaust-gas recirculation device, with the EGR valve set in the rest position;

b) exhaust-gas recirculation during a low-load phase, wherein the exhaust-gas recirculation takes place through the bypass line, with the EGR valve set in the second position, wherein no cooling of the recirculated exhaust gas takes place;

c) exhaust-gas recirculation during load operation, wherein the exhaust-gas recirculation takes place through the exhaust-gas cooler, with the EGR valve set in the second position; and d) enabling at least one additional cooling stage by the at least one flap arrangement if high-load operation is present.

9. A motor vehicle having an internal combustion engine as claimed in claim 1.

* * * * *